US011420407B2

(12) United States Patent
Schmitt et al.

(10) Patent No.: US 11,420,407 B2
(45) Date of Patent: Aug. 23, 2022

(54) DIE FOR A PRESS AND METHOD FOR PRODUCING A GREEN BODY BY MEANS OF A PRESS

(71) Applicant: GKN Sinter Metals Engineering GmbH, Radevormwald (DE)

(72) Inventors: Rainer Schmitt, Wachtberg (DE); Tobias Müller, Bonn (DE); Thomas Schupp, Radevormwald (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 330 days.

(21) Appl. No.: 16/472,385

(22) PCT Filed: Dec. 13, 2017

(86) PCT No.: PCT/EP2017/082544
§ 371 (c)(1),
(2) Date: Jun. 21, 2019

(87) PCT Pub. No.: WO2018/114502
PCT Pub. Date: Jun. 28, 2018

(65) Prior Publication Data

US 2019/0358925 A1 Nov. 28, 2019

(30) Foreign Application Priority Data

Dec. 22, 2016 (DE) ..... 10 2016 125 406.1

(51) Int. Cl.
*B30B 15/02* (2006.01)
*B21J 13/02* (2006.01)
*B22F 3/03* (2006.01)

(52) U.S. Cl.
CPC ..... *B30B 15/026* (2013.01); *B21J 13/02* (2013.01); *B22F 3/03* (2013.01); *B30B 15/02* (2013.01); *B30B 15/022* (2013.01)

(58) Field of Classification Search
CPC ..... B30B 15/02; B30B 15/022
See application file for complete search history.

(56) References Cited

U.S. PATENT DOCUMENTS 3,608,351 A 9/1971 Strandell
3,691,816 A * 9/1972 Strandell ..... B30B 15/022 72/467

(Continued)

FOREIGN PATENT DOCUMENTS

CH 620396 A5 11/1980
CN 2887590 Y 4/2007

(Continued)

OTHER PUBLICATIONS

National Intellectual Property Administration, P.R. China, First Office Action and Search Report, Application No. 201780087205X, dated Dec. 14, 2020, 13 pages [English Language Translation Only].

(Continued)

*Primary Examiner* — Joseph S Del Sole
*Assistant Examiner* — Thu Khanh T Nguyen
(74) *Attorney, Agent, or Firm* — Quarles & Brady LLP

(57) ABSTRACT

The invention relates to a die for arrangement in a press, wherein the die extends along an axial direction between two end faces and forms an inner peripheral surface between the end faces, wherein the die extends from the inner peripheral surface along a radial direction toward an outer peripheral surface and toward at least one centering surface that is disposed in the radial direction on a first diameter, wherein the die has a pressing zone that is spaced apart from the end faces and, in the vicinity of the pressing zone, the die has a greater maximum first stiffness, at least relative to zones of the die that are arranged on the end faces, compared to a pressing force acting on the inner peripheral surface in a direction of a normal vector, and wherein the maximum (Continued)

first stiffness is at least 10% greater than a minimum second stiffness that is present in at least one zone that is arranged on one of the end faces.

19 Claims, 5 Drawing Sheets

(56) References Cited

U.S. PATENT DOCUMENTS

| | | | |
|---|---|---|---|
| 5,019,114 | A | 5/1991 | Gronbaek |
| 5,577,406 | A | 11/1996 | Gronbaek |
| 2002/0044985 | A1 | 4/2002 | Nordell et al. |

FOREIGN PATENT DOCUMENTS

| | | | |
|---|---|---|---|
| CN | 101569930 | A | 11/2009 |
| CN | 102770222 | A | 11/2012 |
| DE | 720296 | C | 4/1942 |
| GB | 1560002 | A | 1/1980 |
| JP | S533977 | B2 | 2/1978 |
| JP | H06106290 | A | 4/1994 |
| JP | 2006144050 | A | 6/2006 |
| JP | 2008284566 | A | 11/2008 |
| JP | 2016179486 | A | 10/2016 |
| WO | 2015151825 | A1 | 10/2015 |

OTHER PUBLICATIONS

PCT International Search Report, PCT/EP2017/082544, dated Mar. 15, 2018, 7 pages.

PCT Written Opinion, PCT/EP2017/082544, dated Mar. 15, 2018, 13 pages.

Japan Patent Office, Notice of Reasons for Rejection, Application No. 2019-534093, dated Dec. 7, 2021, 3 pages [English Language Translation Only].

Intellectual Property India. Examination Report for application 201917024726. dated May 24, 2021. 5 pages.

* cited by examiner

DIE FOR A PRESS AND METHOD FOR PRODUCING A GREEN BODY BY MEANS OF A PRESS

This application represents the U.S. national stage entry of International Application No. PCT/EP2017/082544 filed Dec. 13, 2017, which claims priority to German Patent Application No. 10 2016 125 406.1 filed Dec. 22, 2016, the disclosure of which is incorporated herein by reference in its entirety and for all purposes.

The invention relates to a die for a press, particularly for a powder press for manufacturing green compacts. In particular, the press is used to manufacture sinterable green compacts—i.e., green compacts that can be sintered after the pressing process. In particular, metallic and/or ceramic powders can be pressed into green compacts in the die.

Known dies of this type include a so-called shrink ring, it being possible for a core (particularly made of hard metal) to be arranged within the shrink ring which then forms the inner peripheral surface of the die. On the one hand, the inner peripheral surface of the die forms the receptacle for the powder or the green compact to be produced. In particular, at least one upper punch of the press can travel into the die along an axial direction via an upwardly open first end face of the die. The at least one upper punch slides along the inner peripheral surface of the die and increasingly compresses the powder. In particular, at least one lower punch can be additionally provided which moves into the die via a downwardly open second end face of the die along the axial direction, or moves in the die between an upper position and a lower position. The powder is thus pressed into a green compact between the at least one upper punch and the at least one lower punch, the inner peripheral surface of the die particularly defining a lateral contour of the green compact.

In particular, the die has a collar on an outer peripheral surface via which the die can be received and clamped in the press. The collar extends in a radial direction over the outer peripheral surface, so that the die can be placed onto and/or supported on a support of the press. Moreover, such dies are substantially cylindrical, the cylindrically shaped outer peripheral surface usually being received via a radial clearance in the press, thus enabling a centering of punch(es) and die relative to one another—i.e., a coaxial arrangement of punch(es) and die.

A die can have punch guide zones on its respective end faces, in which case a pressing zone is present at a distance from the end faces and adjacent to the punch guide zones. The pressing zone is the area in which the powder is compressed with the greatest pressing force. The pressing zone is clearly defined in the die and bounded along the axial direction. Furthermore, a demolding zone—i.e., a zone of the die through which the green compact is pushed out of the die (demolded) and provided for removal from the press—can be provided at least on one end face. During the pressing of the powder, an equally strong bonding pressure is applied to the inner peripheral surface of the die. In the process, the inner peripheral surface of the die is elastically expanded in the radial direction (or in the direction of a normal vector that is respectively present on the inner peripheral surface, which is thus arranged so as to be perpendicular to the respective surface of the inner peripheral surface). This expansion in the pressing zone now results in strong frictional forces during demolding. These frictional forces can extend into the demolding zone, because the die is usually cylindrical and therefore has a substantially constant stiffness (i.e., a substantially constant resistance to an elastic expansion in the radial direction or in the direction of a normal vector that is respectively present on the inner peripheral surface and is thus arranged so as to be perpendicular to the respective surface of the inner peripheral surface) along the axial direction.

This expansion only in the pressing zone of the die also has the effect that the green compact cannot be produced with dimensional accuracy. In particular, a conicity of the green compact can occur during the demolding of the green compact. In that case, the die rebounds in the pressing zone as demolding progresses, so that the green compact is increasingly constricted at its lower end and consequently takes on an overall conical shape.

In order to reduce these frictional forces, it has been proposed to provide drafts on the inner peripheral surface of the die, so that, as the green compact moves along the axial direction from the pressing zone and through the demolding zone to the end face, a relaxation of the green compact occurs.

Known designs of such dies are associated with high costs, for example due to the material used for the die and/or also for auxiliary devices that are required for handling the die or for assembly and disassembly in the press.

Proceeding from this background, it is an object of the present invention to at least partially solve the problems described with reference to the prior art. In particular, unwanted but previously process-related conicities on the green compact are to be avoided. Non-rotationally symmetrical components are also to be manufacturable with high accuracy. In particular, a die for a press is to be provided which has a lower weight than conventional dies without impairing the dimensional accuracy of the green compacts to be produced. Furthermore, it should be preferably possible to reduce the frictional forces that occur during demolding of the green compact without the need for drafts.

A die according to the features of claim 1 is proposed in order to achieve this object. Advantageous developments are the subject of the dependent claims. The features listed individually in the claims can be combined in a technologically meaningful manner and supplemented by explanatory facts from the description and details of the figures, with additional design variants of the invention being indicated.

For this purpose, a die contributes to the arrangement in a press, the die extending along an axial direction between a first end face and an (opposite) second end face and forming an inner peripheral surface between the end faces. The die extends from the inner peripheral surface along a radial direction toward an outer peripheral surface and toward at least one centering surface that is disposed in the radial direction on a first diameter. The die has a pressing zone that is spaced apart from the end faces. In the vicinity of the pressing zone, the die has a greater maximum first stiffness (i.e., the greatest first stiffness present there), at least relative to zones of the die that are arranged on the end faces, compared to a pressing force acting on the inner peripheral surface (or the bonding pressure acting there) in a direction of a normal vector (i.e., of a normal vector that is present on the respective portion of the inner peripheral surface, which normal vector is thus arranged so as to be perpendicular to the respective surface of the portion of the inner peripheral surface). The maximum first stiffness is at least 10%, particularly at least 15%, preferably at least 20%, especially preferably at least 40% greater than a minimum second stiffness that is present in at least one of the zones arranged on one of the end faces (i.e., the least second stiffness present there). Very especially preferably, this applies to both zones that are arranged on the end faces.

The maximum first stiffness is preferably greater, particularly by at least 10%, preferably by at least 15%, especially preferably by at least 20%, or even by at least 40%, than a maximum second stiffness in at least one zone that is arranged on one of the end faces (i.e., the greatest second stiffness present there). Very especially preferably, this applies to both zones that are arranged on the end faces.

The stiffnesses denote particularly the resistance of the inner peripheral surface to a deformation in the radial direction (or in the direction of a normal vector that is respectively present on the inner peripheral surface, which is thus arranged so as to be perpendicular to the respective surface of the inner peripheral surface). The unit of stiffness is: N/m [Newton/meter].

As an example, the stiffness can be determined as follows: By means of an FEM analysis, in which the deformation, particularly the elastic deformation, of the die at a certain pressing force [N] acting particularly perpendicularly on the inner peripheral surface of the die is determined (i.e., the displacement of the material of the die in the direction of the normal vector of the inner peripheral surface of the die, which can be specified in [m]). The ratio of these quantities (pressing force [N]/material displacement [m]) represents the stiffness of the die.

The lower the stiffness of the die, the greater the elastic deformation of the die. The die should therefore be as stiff as possible in the pressing zone in order to ensure the dimensional stability of the green compact. In particular, the die should have the least stiffness in the vicinity of the lower and/or upper end face in order to have greater elasticity particularly in the demolding zone, so that the frictional forces in this zone are minimized and, if necessary, the surface of the green compact is not impaired or only to a slight extent.

The die is intended particularly for a powder press for manufacturing green compacts. In particular, the press is used to manufacture sinterable green compacts—i.e., green compacts that can be sintered after the pressing process. In particular, metallic or also ceramic powders can be pressed into green compacts in the die.

In particular, the die comprises a so-called shrink ring, it being possible for a core (particularly made of hard metal) which then forms the inner peripheral surface of the die. On the one hand, the inner peripheral surface of the die forms the receptacle for the powder or the green compact to be produced. In particular, at least one upper punch of the press can travel into the die along an axial direction via an upwardly open first end face of the die. The at least one upper punch slides along the inner peripheral surface of the die and increasingly compresses the powder. In particular, at least one lower punch can be additionally provided which moves into the die via a downwardly open second end face of the die along the axial direction. The powder is thus pressed into a green compact between the at least one upper punch and the at least one lower punch, the inner peripheral surface of the die particularly defining a lateral contour of the green compact. The pressing force is introduced into the powder by means of the punches. The pressing force is maintained over the punches and the die. At the same time, the pressing force acts on the die in the direction of the normal vector.

In particular, the die has a respective punch guide zone on the end faces (optionally immediately adjacent thereto) as zones, with a pressing zone being present at a distance from the end faces and (optionally immediately) adjacent to the punch guide zone. It is in the pressing zone that the powder is compressed with the greatest pressing force. In particular, the pressing zone is defined by the region along the axial direction in which the powder is arranged during the application of the greatest pressing force.

Furthermore, a demolding zone is present at least on one end face—i.e., an area of the die through which the green compact is pushed out of the die (demolded) and provided for removal from the press.

In particular, the die is aligned with the punches in the press by means of the at least one (outer) centering surface. However, it is also possible in particular for the die to be centered relative to the punches by means of other surfaces, e.g., parts of the outer peripheral surface. In particular, the smallest radial clearance between die and press in the radial direction (with the exception of connections for cooling lines, etc.) lies between the centering surface (or the respective surface used for centering) and the press. In particular, the at least one centering surface lies on the largest first diameter of the die—that is, the die extends only within the first diameter.

In particular, the centering surfaces, or the top and bottom side of the die, in the immediate vicinity of the centering surfaces are used as collars for clamping the die in a receptacle (an adapter) of the press. However, other surfaces are also suitable here for use as a collar for clamping the die by receiving the presses.

The die that is proposed herein is designed in particular such that a maximum or the greatest possible first stiffness is present (only) in the vicinity of the pressing zone. By virtue of this high first stiffness, dimensionally accurate production of the green compact by the press and the pressing process can be ensured. On the other hand, a second stiffness in the vicinity of the end faces of the die is designed to be substantially smaller, because a substantially lesser load acts on the die in these regions (which are bounded in the axial direction) as a result of the pressing force component acting in the direction of the normal vector.

In particular, a majority of the material that is usually present in cylindrically shaped dies can be saved due to the lesser second stiffness. Weight savings of at least 25%, preferably of at least 50%, and especially preferably of at least 75% can thus be achieved compared to cylindrically designed dies.

In particular, the die has integrated cooling lines and/or heating lines that are required for temperature-controlling the die during the pressing operations.

The design and layout of the die is created particularly through calculation and simulation of the loads and deformations of the die that occur (e.g., by means of FEM calculations: finite element method). Programs for topology optimization can also be used here.

The lesser second stiffness particularly has the effect that the frictional forces can be reduced during demolding of the green compact from the die. In particular, drafts on the green compact and/or on the inner peripheral surface of the die are no longer absolutely necessary, so that very dimensionally stable and cylindrical outer peripheral surfaces of the green compact can be produced. What is more, the stress on the die due to the friction during demolding is reduced, so that the wearing of the die can be reduced. In addition, the restorative forces of the die during the demolding of the green compact via one end face are reduced, so that the green compact is less constricted and therefore has a very little or even no (unwanted) conicity.

The savings of the material of the die now results particularly in substantial weight savings. However, the handling of the die, particularly during assembly in the press or disassembly from the press, can be facilitated in this way.

Exclusively manual handling of the die, meaning movement of the die without mechanical aids (e.g., crane, hoist, or the like), is now even possible in some circumstances. However, the aids used can be designed for less weight in any case, meaning that a substantial cost reduction can be achieved in this regard as well. Currently, only presses with a pressing force of up to 1500 kN [kiloNewton] are able to be set up manually. As a result of the weight reduction proposed herein, presses with a pressing force of up to 4000 kN can be set up manually in the future. In particular, it is also not necessary to change adapters for the die in the case of manual setup. This eliminates the need for a second adapter and an adapter station. The risk of damaging the die or the punch as a result of the contact of the die with the sharp-edged punches of the press can also be reduced.

The first stiffness along a peripheral direction of the die can be different or vary in the peripheral direction. In particular, the die is therefore not designed to be rotationally symmetrical about an axis parallel to the axial direction (or, in particular, only in the case of a rotation of 180 degrees along the peripheral direction). Such a design of the die is advantageous, for example, when non-rotationally symmetrical, e.g., cuboid, green compacts are produced.

In particular, the at least one centering surface is arranged (at least partially, or exclusively) in the pressing zone along the axial direction. According to another embodiment, the at least one centering surface can also be arranged at least partially in one of the zones that adjoin the end faces and, in particular, completely outside of the pressing zone. In this case, however, it is crucial that the first stiffness in the pressing zone be elevated in comparison to the second stiffnesses in the other zones.

In particular, the at least one centering surface has a first height along the axial direction, the first height corresponding to no more than 80% of a shortest distance between the end faces. The shortest distance is preferably determined in the region of the transition from the end faces to the inner peripheral surface.

According to a preferred embodiment, the die, along the radial direction between the inner peripheral surface and the first diameter, has at least one cross section that is reduced at least in the axial direction or connecting regions that are arranged at a distance from one another in the peripheral direction.

The cross section that is reduced in the axial direction describes the shape of the die at the end faces in the region between the inner peripheral surface and the first diameter. A sort of constriction of the shape of the die can be provided here, meaning that the die has a shorter distance between the end faces in this region than in the vicinity of the inner peripheral surface.

The connecting regions describe the shape of the die along the peripheral direction. Free spaces (i.e., spaces without material of the die) can be present here between the inner peripheral surface and the first diameter. In that case, spokes can be formed by the connecting regions that connect the inner peripheral surface to a centering surface that is arranged on the first diameter.

In particular, the connecting regions are arranged so as to be additionally spaced apart in the axial direction. In particular, spokes can thus be formed that are arranged in at least partially identical positions in the peripheral direction but in different positions in the axial direction.

In particular, a second diameter is arranged between the inner peripheral surface and the first diameter, with a cross-sectional area of the die present on a second diameter corresponding to no more than 80%, particularly no more than 60%, preferably no more than 40% of the inner peripheral surface. As explained above, areas without material—i.e., free spaces—are thus provided on this second diameter. In particular, an additional cross-sectional area is provided between the second diameter and the first diameter that is greater than the cross-sectional area present on the second diameter.

In particular, a plurality of centering surfaces are arranged on the first diameter, with the centering surfaces being arranged so as to be spaced apart from one another along the peripheral direction. In particular, at least three centering surfaces are provided which are arranged so as to be spaced apart from one another along the peripheral direction.

The at least one centering surface can be embodied so as to extend circumferentially in the peripheral direction. This means, for example, that this centering surface is continuous over the periphery.

The die can have at least one retaining portion that is arranged at a distance from the at least one centering surface in the axial direction. The retaining portion is provided particularly for the purpose of facilitating the handling of the die. In particular, the retaining portion serves as a handle for manual handling of the die. Preferably, the retaining portion is embodied as a single piece with—i.e., is integrally connected to—the die. Alternatively, the retaining portion can also be secured to the die by means of screws, for example.

In particular, the retaining portion is arranged in the radial direction between the inner peripheral surface and the first diameter.

The retaining portion preferably extends in the manner of a ring.

As will readily be understood, the special shape of the dies that is proposed here can be produced using the known manufacturing methods such as turning, milling, sawing, drilling and grinding, wire cutting, die sinking, and hard milling, etc. It is especially advantageous, however, to manufacture the die or at least the shrink rings by means of so-called additive methods, e.g., laser sintering (3D printing process for producing spatial structures from powdery starting material through sintering, with the workpiece being produced in layers). This enables a truly free design of the die to be achieved in which the weight of the die can be reduced to the greatest possible extent.

A method for manufacturing at least one green compact with a press is also proposed in which the press has at least one die as described above and at least one punch that can travel along the axial direction via an end face of the die into a receptacle for the green compact that is formed by the inner peripheral surface, the method comprising at least the following steps:

placing a powder in the receptacle;

moving the at least one punch in the die along the axial direction and compressing the powder into a green compact in the pressing zone;

demolding the green compact from the die via an end face of the die;

wherein, at a distance from the end faces, the die has the pressing zone and, in the vicinity of the pressing zone, a greater maximum first stiffness, at least relative to zones that are arranged on the end faces, compared to a pressing force acting on the inner peripheral surface in a direction of a normal vector at least in step b), the maximum first stiffness being at least 10% greater than a minimum second stiffness that is present in at least one zone that is arranged on one of the end faces.

In particular, it is proposed that the green compact be removed from the die in step c) via a first zone that is arranged on the first end face, the maximum first stiffness being at least 10% greater than at least the minimum second stiffness that is present in the first zone.

The remarks regarding the die apply equally to the method, and vice versa.

By way of precaution, it should be noted that the number words used here ("first," "second," . . . ) serve primarily (only) to distinguish a plurality of similar objects or quantities; that is, they do not prescribe any dependency and/or order of these objects or quantities relative to one another. Should a dependency and/or order be required, this is explicitly stated herein or it obviously follows for a person skilled in the art when studying the embodiment specifically described.

The invention and the technical environment will be explained in greater detail with reference to the figures. It should be noted that the invention is not intended to be limited by the embodiments shown. In particular, unless explicitly stated otherwise, it is also possible to extract partial aspects of the features explained in the figures and to combine them with other components and insights from the present description and/or figures. In particular, it should be pointed out that the figures and, in particular, the illustrated proportions are only schematic. Same reference symbols designate same objects, so that explanations of other figures can be consulted where necessary. In the drawing:

Figure 1:
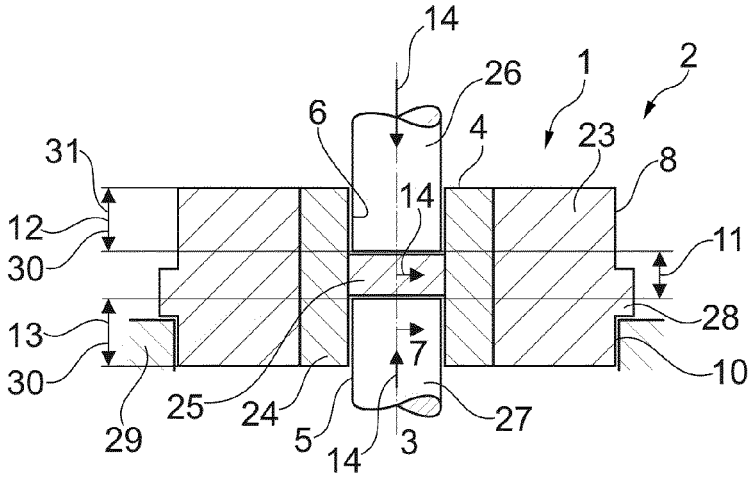
FIG. 1 shows a known die in a sectional view from the side.
Figure 2:
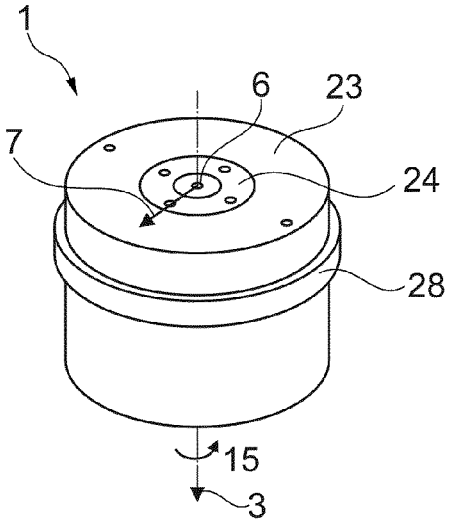
FIG. 2 shows the die according to FIG. 1 in a perspective view.

FIG. 1 shows a known die 1 in a sectional view from the side. FIG. 2 shows the die 1 according to FIG. 1 in a perspective view. FIGS. 1 and 2 are described together below.

The die 1 comprises a so-called shrink ring 23, a core 24 being arranged within the shrink ring 23 that then forms the inner peripheral surface 6 of the die 1. For one, the inner peripheral surface 6 of the die 1 forms the receptacle for the powder and the green compact 25 to be produced. An upper punch 26 of the press 2 can travel along an axial direction 3 into the die 1 via an upwardly open end face 4 of the die 1. The upper punch 26 slides along the inner peripheral surface 6 of the die 1 and increasingly compresses the powder. A lower punch 27 is additionally provided here which (during the assembly of the die 1) travels along the axial direction 3 into the die 1 via a downwardly open second end face 5 of the die 1 and moves up and down within the die 1 until the disassembly of the die 1. The powder is thus pressed between the upper punch 26 and the lower punch 27 by pressing forces 14 into a green compact 25, the inner peripheral surface 6 of the die 1 defining a side contour of the green compact 25 in particular.

The die 1 has a collar 28 on an outer peripheral surface 8 via which the die 1 can be received and clamped in the press 2. The collar 28 extends in a radial direction 7 beyond the outer peripheral surface 8, so that the die 1 can be placed onto a support 29 of the press 2. The die 1 is cylindrical, the cylindrically shaped outer peripheral surface 8 being received via a radial clearance in the press 2, thus enabling a centering of punches 26, 27 and die 1—i.e., a coaxial arrangement of punches 26, 27 and die 1.

The die 1 has a first zone 12 on the first end face 4 and a second zone 13 on the second end face 5, each of which is designated as a punch guide zone 30. A pressing zone 11 is present at a distance from the end faces 4, 5 and adjacent to the punch guide zones 30. The pressing zone 11 is the area in which the powder is compressed with the greatest pressing force 14. The pressing zone 11 is clearly defined in the die 1 and bounded along the axial direction 3. Furthermore, a demolding zone 31 is present on the first end face 4—i.e., an area of the die 1 through which the completely pressed green compact 25 is pushed out of the die 1 (demolded) and provided for removal from the press 2. During the pressing of the powder, an equally strong bonding pressure is applied to the inner peripheral surface 6 of the die 1. The inner peripheral surface 6 of the die 1 is elastically expanded in the direction of the normal vector 32. This expansion in the pressing zone 11 now results in strong frictional forces during demolding. These frictional forces extend into the demolding zone 31, since the die 1 is usually cylindrical and therefore has a substantially constant stiffness (i.e., a resistance to an elastic expansion in the direction of the normal vector 32 that is essentially unchanging) along the axial direction 3. This expansion only in the pressing zone 11 of the die 1 also has the effect that the green compact 25 cannot be produced with dimensional accuracy. A conicity of the green compact 25 can occur during demolding of the green compact 25. In that case, the die 1 rebounds in the pressing zone 11 as demolding progresses, so that the green compact 25 is increasingly constricted at its lower end and consequently takes on an overall conical shape.

Figure 3:
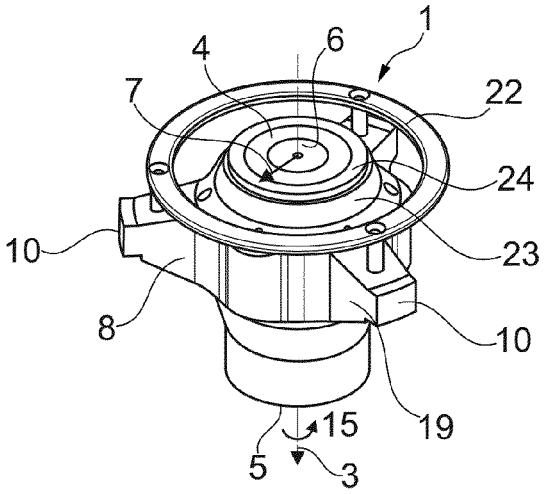
FIG. 3 shows a die according to a first design variant in a perspective view.
Figure 4:
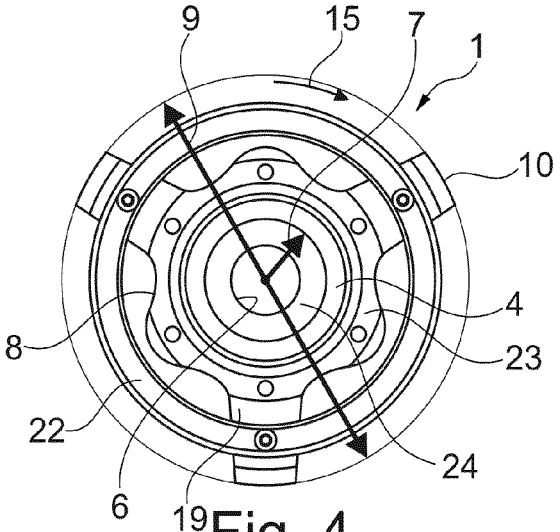
FIG. 4 shows a top view of the die according to FIG. 3.
Figure 5:
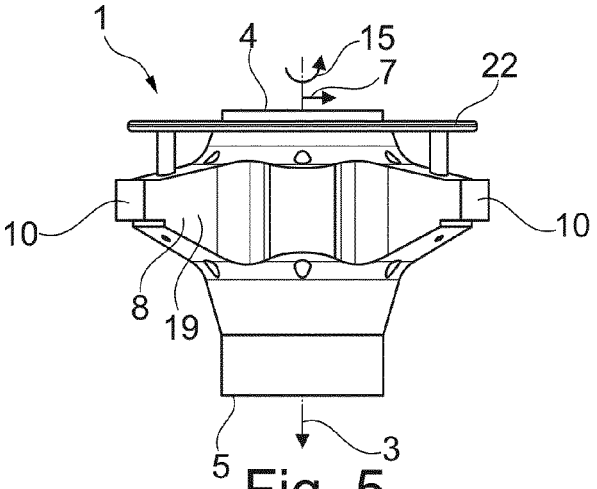
FIG. 5 shows a side view of the die according to FIGS. 3 and 4.
Figure 6:
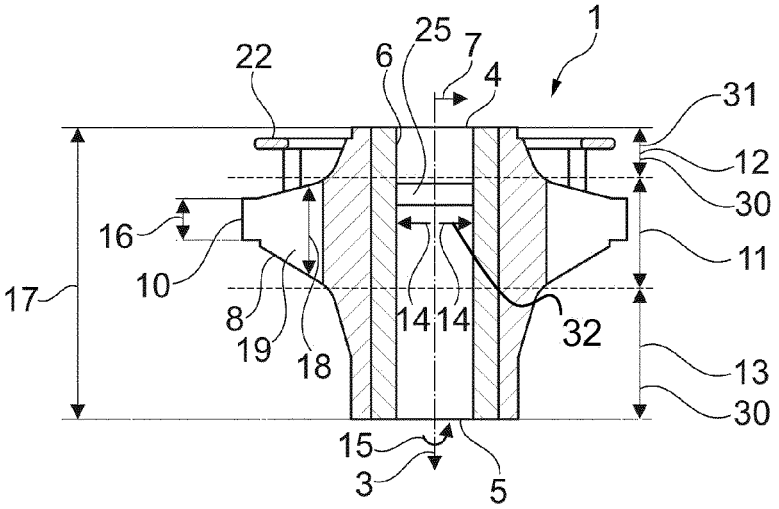
FIG. 6 shows the die according to FIGS. 3 to 5 in a sectional view from the side.

FIG. 3 shows a die 1 according to a first design variant in a perspective view. FIG. 4 shows the die 1 according to FIG. 3 in a top view. FIG. 5 shows a side view of the die according to FIGS. 3 and 4. FIG. 6 shows the die 1 according to FIGS. 3 to 5 in a sectional view from the side. FIGS. 3 to 6 are described together below.

The die 1 extends along an axial direction 3 between two end faces 4, 5 and forms an inner peripheral surface 6 between the end faces 4, 5. The die 1 extends from the inner peripheral surface 6 along a radial direction 7 toward an outer peripheral surface 8 and toward three centering surfaces 10 that are disposed in the radial direction 7 on a first diameter 9. The die 1 has a pressing zone 11 that is spaced apart from the end faces 4, 5. In the vicinity of the pressing zone 11, the die 1 has a greater maximum first stiffness (i.e., the greatest first stiffness present there), at least relative to the zones 12, 13 that are arranged on the end faces 4, 5, compared to a pressing force 14 acting on the inner peripheral surface 6 in the direction of the normal vector 32.

The die 1 is provided for a powder press for the purpose of manufacturing green compacts 25. Sinterable green compacts 25 are manufactured with the press 2 that can be sintered after the pressing process. Metallic or also ceramic powders can be pressed into green compacts 25 in the die 1.

The die 1 comprises a so-called shrink ring 23, a core 24 being arranged within the shrink ring 23 that then forms the inner peripheral surface 6 of the die 1. For one, the inner peripheral surface 6 of the die 1 forms the receptacle for the powder and the green compact 25 to be produced. An upper punch 26 of the press 2 can travel along an axial direction 3 into the die 1 via an upwardly open end face 4 of the die 1. The upper punch 26 slides along the inner peripheral surface 6 of the die 1 and increasingly compresses the powder. A lower punch 27 is additionally provided here which moves into the die 1 via a downwardly open second end face 5 of the die 1 along the axial direction 3. The powder is thus pressed between the upper punch 26 and the lower punch 27 by pressing forces 14 into a green compact 25, the inner peripheral surface 6 of the die 1 defining a side contour of the green compact 25 in particular. The pressing force 14 is introduced into the powder by means of the punches 26, 27. The pressing force 14 is maintained over the punches 26, 27 and the die 1. At the same time, the pressing force 14 acts on the die 1 in the direction of the normal vector 32.

The die 1 has punch guide zones 30 on its respective end faces 4, 5 as zones 12, 13, with a pressing zone 11 being present at a distance from the end faces 4, 5 and adjacent to the punch guide zones 30. It is in the pressing zone 11 that the powder is compressed with the greatest pressing force. The pressing zone 11 is defined by the region along the axial direction 3 in which the powder is arranged during the application of the greatest pressing force 14 (see FIG. 1).

Furthermore, a demolding zone 31—i.e., a first zone 12 of the die 1 through which the green compact 25 is pushed out of the die 1 (demolded) and provided for removal from the press 2—is present at least on the first end face 4.

The die 1 is aligned in the press 2 relative to the punches 26, 27 by means of the centering surfaces 10. The centering surfaces 10 lie on the largest first diameter 9 of the die 1—that is, the die 1 extends only within the first diameter 9.

In the die 1 proposed here, it has been assumed that a maximally high stiffness should be present only in the vicinity of the pressing zone 11. By virtue of this high first stiffness, dimensionally accurate production of the green compact 25 by the press 2 and the pressing process can be ensured. On the other hand, a second stiffness in the vicinity of the end faces 4, 5 of the die 1 can be designed to be substantially smaller, since a substantially lesser load acts on the die 1 in these regions (which are bounded in the axial direction 3) as a result of the pressing force (component) 14 acting in the direction of the normal vector 32.

A majority of the material that is usually present in cylindrically shaped dies 1 (see FIGS. 1 to 3) can be saved due to the lesser second stiffness.

The centering surfaces 10 are arranged exclusively in the pressing zone 11 along the axial direction 3.

The centering surfaces 10 have a first height 16 along the axial direction 3, the first height 16 being smaller than a shortest distance 17 between the end faces 4, 5.

The die 1 has at least one cross section 18 along the radial direction 7 between the inner peripheral surface 6 and the first diameter 9 that is reduced at least in the axial direction 3 or connecting regions 19 that are arranged at a distance from one another in the peripheral direction 15.

The cross section 18 that is reduced in the axial direction 18 describes the shape of the die 1 at the end faces 4, 5 in the region between the inner peripheral surface 6 and the first diameter 9. A constriction of the shape of the die 1 is thus present here, meaning that the die 1 has a shorter distance 17 between the end faces 4, 5 in this region than in the vicinity of the inner peripheral surface 6.

The connecting regions 19 describe the shape of the die 1 along the peripheral direction 15. Free spaces (i.e., spaces without material of the die 1) are present here between the inner peripheral surface 6 and the first diameter 9. Spokes are formed by the connecting regions 19 that connect the inner peripheral surface 6 to a centering surface 10 that is arranged on the first diameter 9.

Three centering surfaces 10 are arranged here on the first diameter 9, with the centering surfaces 10 being arranged so as to be spaced apart from one another along the peripheral direction 15.

In addition, the die 1 has a retaining portion 22 that is arranged so as to be spaced apart from the centering surfaces 10 in the axial direction 3.

The retaining portion 22 is provided for the purpose of facilitating the handling of the die 1. The retaining portion 22 serves as a handle for manual handling of the die 1. In the present case, the retaining portion 22 is fastened to the die 1 by means of screws (see FIG. 4).

In particular, the retaining portion 22 is arranged in the radial direction 7 between the inner peripheral surface 6 and the first diameter 9. The retaining portion 22 extends in the manner of a ring.

In FIG. 6, the green compact 25 is arranged within the pressing zone 11. The green compact 25 is formed in step b) of the method in the pressing zone by compressing a powder. The greatest bonding pressure is reached in the pressing zone 11. In step c) of the method (not shown here), the green compact 25 is removed from the mold via the first zone 12 that is provided as the demolding zone 31, which is arranged on the first end face 4.

Figure 7:
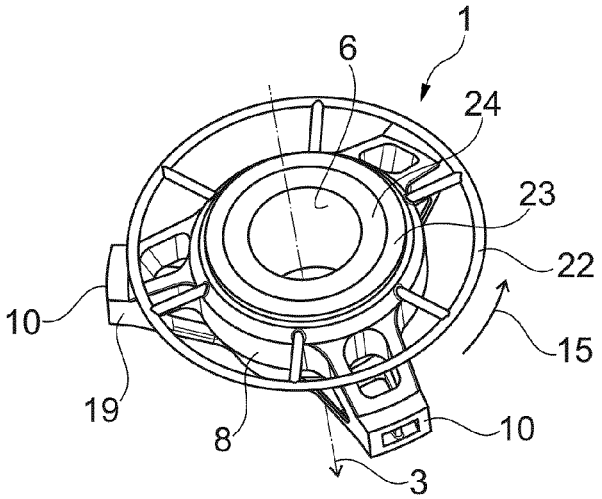
FIG. 7 shows a die according to a second design variant in a perspective view.

FIG. 7 shows a die 1 according to a second design variant in a perspective view. Reference is made to the remarks in relation to FIGS. 3 to 6. Unlike the first design variant, the die 1 has additional free spaces or recesses in the vicinity of the connecting regions 19. The connection of the retaining portion 22 to the die 1 and to the shrink ring 23 is also set up differently here.

Figure 8:
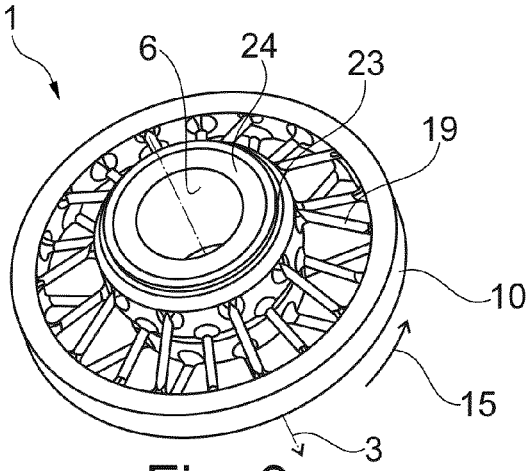
FIG. 8 shows a die according to a third design variant in a perspective view.

FIG. 8 shows a die 1 according to a third design variant in a perspective view. Reference is made to the remarks in relation to FIGS. 3 to 6. Unlike the first design variant, the connecting regions 19 are additionally spaced apart from one another in the axial direction 3. Spokes are thus formed which are arranged in at least partially identical positions in the peripheral direction 15 but in different positions in the axial direction 3. In addition, the centering surface 10 is embodied so as to extend circumferentially in the peripheral direction 15.

The connecting regions 19 can be used here as handles for the manual handling of the die 1.

Figure 9:
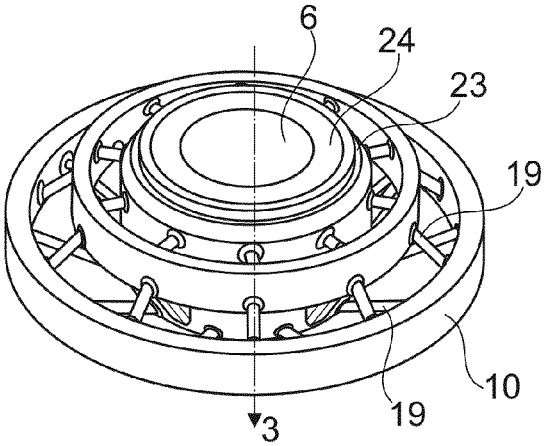
FIG. 9 shows a die according to a fourth design variant in a perspective view.

FIG. 9 shows a die 1 according to a fourth design variant in a perspective view. Reference is made to the remarks in relation to FIGS. 3 to 6 and to FIG. 8. Unlike FIG. 8, an additional circumferential intermediate ring is provided here between the inner peripheral surface 6 and the circumferential centering surface 10.

Figure 10:
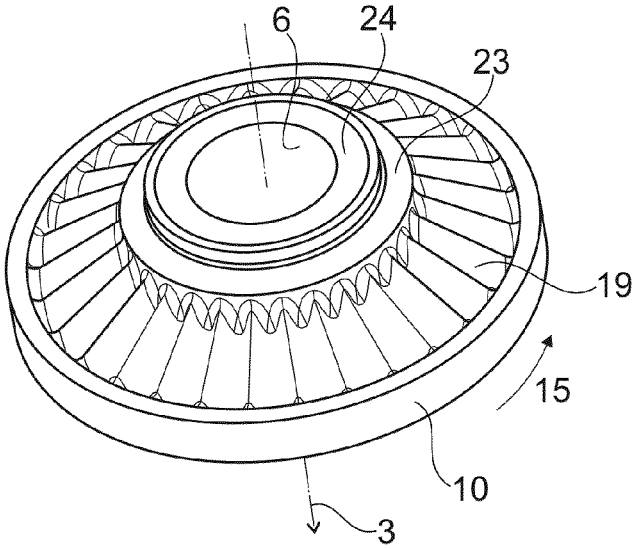
FIG. 10 shows a die according to a fifth design variant in a perspective view.
Figure 11:
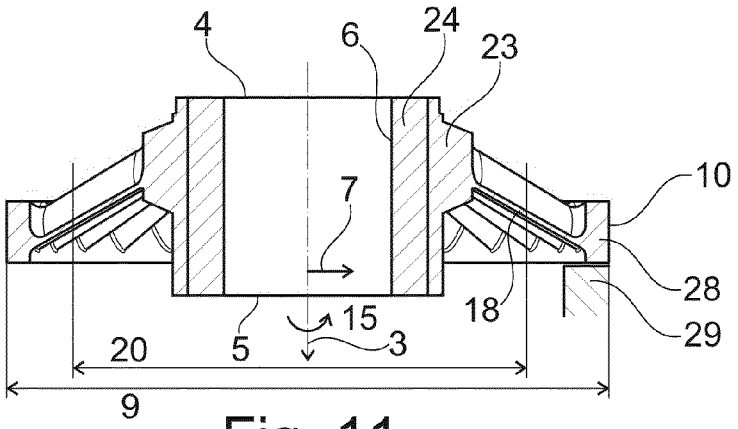
FIG. 11 shows the die according to FIG. 10 in a sectional view from the side.
Figure 12:
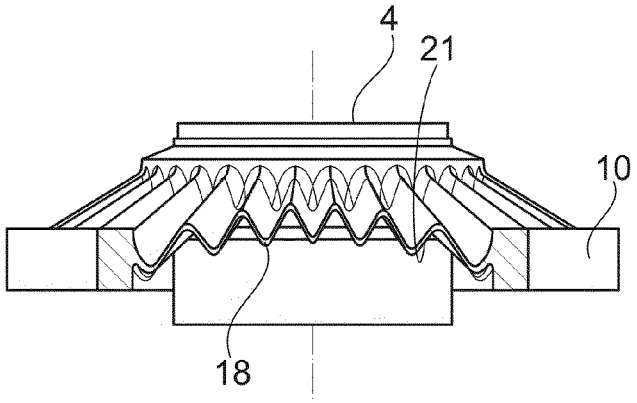
FIG. 12 shows the die according to FIGS. 10 and 11 in a sectional view from the side.

FIG. 10 shows a die 1 according to a fifth design variant in a perspective view. FIG. 11 shows the die 1 according to FIG. 10 in a sectional side view, with the section running through the center axis of the die 1. FIG. 12 shows the die 1 according to FIGS. 10 and 11 in a sectional side view, with the section line running here so as to be laterally offset from the central axis. Reference is made to the remarks in relation to FIGS. 3 to 6 and to FIG. 8. In contrast to FIG. 8, a corrugated region is formed here which extends circumferentially in the peripheral direction 15 and has a cross section 18 that is substantially reduced in the axial direction.

A second diameter 20 is arranged between the inner peripheral surface 6 and the first diameter 9, with a cross-sectional area 21 of the die 1 that is present on a second diameter 20 being substantially smaller than the inner peripheral surface 6. An additional cross-sectional area is provided between the second diameter 20 and the first diameter 9 that is greater than the cross-sectional area 21 present on the second diameter 20.

Here, the centering surfaces 10, or the top and bottom side of the die 1, in the immediate vicinity of the centering surfaces 10 are used as collars 28 for clamping the die 1 in a receptacle (an adapter; only a support 29 of the receptacle is shown here) of the press 2.

Figure 13:
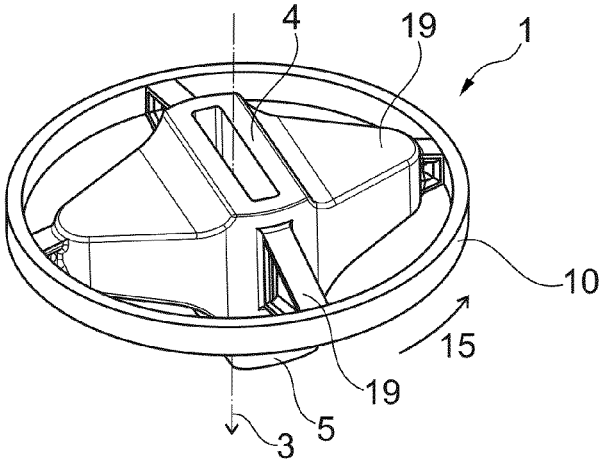
FIG. 13 shows a die according to a sixth design variant in a perspective view.
Figure 14:
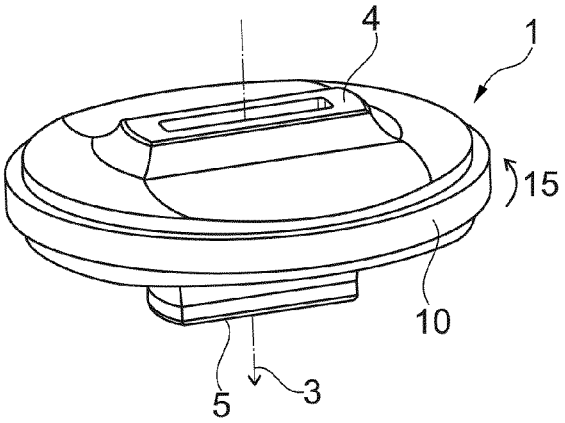
FIG. 14 shows a die according to a seventh design variant in a perspective view.
Figure 15:
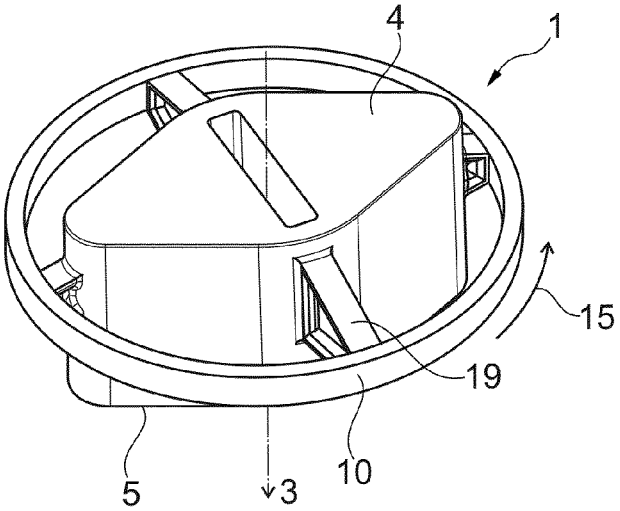
FIG. 15 shows a die according to an eighth design variant in a perspective view.

FIG. 13 shows a die 1 according to a sixth design variant in a perspective view. FIG. 14 shows a die 1 according to a seventh design variant in a perspective view. FIG. 15 shows a die 1 according to an eighth design variant in a perspective view. FIGS. 13 to 15 are described together below. Reference is made to the remarks in relation to FIGS. 3 to 6 and to FIG. 8. In contrast to FIG. 8, the inner peripheral surface 6 is not rotationally symmetrical here. Due to the shape of the inner peripheral surface 6 or of the receptacle for the powder to be compressed, the amount of pressing force 14 applied by means of the punches 26, 27 and acting on the inner peripheral surface 6 varies as a function of the position along the peripheral direction 15. It is for this reason that the die 1 is designed to have a different first stiffness along the peripheral direction 15. Here, the die 1 is designed to be rotationally symmetrical by an angular step of 180 angular degrees about an axis parallel to the axial direction 3. Such a configuration of the die 1, with a different first stiffness along the peripheral direction 15, is particularly expedient when non-rotationally symmetrical green compacts 25 (or green compacts 25 having a symmetry only when rotated 180 angular degrees) are being produced—for example, cuboid green compacts 25 as shown. By virtue of this special design variant of the die, asymmetrical green compacts 25 can be supported in an ideal manner, so that radially asymmetrical deformations of the die 1 and hence of the green compact 25 can be avoided.

LIST OF REFERENCE SYMBOLS

1 die
2 press
3 axial direction
4 first end face
5 second end face
6 inner peripheral surface
7 radial direction
8 outer peripheral surface
9 first diameter
10 centering surface
11 pressing zone
12 first zone
13 second zone
14 pressing force
15 peripheral direction
16 first height
17 distance
18 cross section
19 connecting region
20 second diameter
21 cross-sectional area
22 retaining portion
23 shrink ring
24 core
25 green compact
26 upper punch
27 lower punch
28 collar
29 support
30 punch guide zone
31 demolding zone
32 direction of the normal vector

The invention claimed is:

1. A die for arrangement in a press, wherein the die extends along an axial direction between a first end face and a second end face and forms an inner peripheral surface between the end faces, wherein the die extends from the inner peripheral surface along a radial direction toward an outer peripheral surface and toward at least one centering surface that is disposed in the radial direction on a first diameter, wherein the die has a pressing zone that is spaced apart from the end faces and the die has a first stiffness in the vicinity of the pressing zone that differs along a peripheral direction and having a maximum first stiffness greater in comparison to zones of the die that are arranged on the end faces that are not in the pressing zone and wherein the maximum first stiffness is at least 10% greater than a minimum second stiffness that is present in at least one zone that is arranged on one of the end faces.

2. The die as set forth in claim 1, wherein the at least one centering surface is arranged in the pressing zone along the axial direction.

3. The die as set forth in claim 1, wherein the at least one centering surface has a first height along the axial direction, the first height corresponding to no more than 80% of a shortest distance between the end faces.

4. The die as set forth in claim 1, wherein the die, along the radial direction between the inner peripheral surface and the first diameter, has at least one cross section that is reduced at least in the axial direction or connecting regions that are arranged at a distance from one another in the peripheral direction.

5. The die as set forth in claim 4, wherein the connecting regions are additionally spaced apart from one another in the axial direction.

6. The die as set forth in claim 1, wherein a second diameter is arranged between the inner peripheral surface and the first diameter, and wherein a cross-sectional area of the die that is present on the second diameter corresponds to no more than 80% of the inner peripheral surface.

7. The die as set forth in claim 1, wherein a plurality of centering surfaces are arranged on the first diameter, with the centering surfaces being arranged so as to be spaced apart from one another along a peripheral direction.

8. The die as set forth in claim 1, wherein the at least one centering surface is embodied so as to extend circumferentially in a peripheral direction.

9. The die as set forth in claim 1, wherein the die has at least one retaining portion that is arranged so as to be spaced apart in the axial direction from the at least one centering surface.

10. A method for manufacturing at least one green compact with a press, wherein the press has at least one die as set forth in claim 1 and at least one punch that can travel along the axial direction via an end face of the die into a receptacle for the green compact that is formed by the inner peripheral surface, the method comprising at least the following steps:

a) placing a powder in the receptacle;

b) moving the at least one punch in the die along the axial direction and compressing the powder into a green compact in the pressing zone;

c) demolding the green compact from the die via an end face of the die.

11. The method as set forth in claim 10, wherein the green compact is removed from the die in step c) via a first zone that is arranged on the first end face, the maximum first stiffness being at least 10% greater than at least the minimum second stiffness that is present in the first zone.

12. A die for arrangement in a press, wherein the die extends along an axial direction between a first end face and a second end face and forms an inner peripheral surface between the end faces, wherein the die extends from the inner peripheral surface along a radial direction toward an outer peripheral surface and toward at least one centering surface that is disposed in the radial direction on a first diameter, wherein the die has a pressing zone that is spaced apart from the end faces and the die has a first stiffness in the vicinity of the pressing zone and having a maximum first stiffness greater in comparison to zones of the die that are arranged on the end faces that are not in the pressing zone and wherein the maximum first stiffness is at least 10% greater than a minimum second stiffness that is present in at least one zone that is arranged on one of the end faces that is not in the pressing zone; wherein the die has connecting regions spaced from each other at least in a circumferential direction along the radial direction between the inner peripheral surface and the first diameter; the die being made by a manufacturing process such as turning, milling, sawing, drilling, grinding, wire cutting, die sinking, and hard milling or a shrink ring being produced by additive processes for the production of three-dimensional structures from powdered starting material by sintering.

13. The die as set forth in claim 12, wherein the connecting regions are additionally arranged at a distance from one another in the axial direction.

14. A die for arrangement in a press, wherein the die extends along an axial direction between a first end face and a second end face and forms an inner peripheral surface between the end faces, wherein the die extends from the inner peripheral surface along a radial direction toward an outer peripheral surface and toward at least one centering surface that is disposed in the radial direction on a first diameter, wherein the die has a pressing zone that is spaced apart from the end faces and the die has a first stiffness in the vicinity of the pressing zone and having a maximum first stiffness greater in comparison to zones of the die that are arranged on the end faces that are not in the pressing zone and wherein the maximum first stiffness is at least 10% greater than a minimum second stiffness that is present in at least one zone that is arranged on one of the end faces that is not in the pressing zone; wherein the die, along the radial direction between the inner peripheral surface and the first diameter at a second diameter has at least one reduced cross-section at least in the axial direction, wherein between the second diameter and the first diameter a further cross-sectional area is provided which is larger than that one cross-sectional area present at the second diameter.

15. A die for arrangement in a press, wherein the die extends along an axial direction between a first end face and a second end face and forms an inner peripheral surface between the end faces, wherein the die extends from the inner peripheral surface along a radial direction toward an outer peripheral surface and toward at least one centering surface that is disposed in the radial direction on a first diameter, wherein the die has a pressing zone that is spaced apart from the end faces and the die has a first stiffness in the vicinity of the pressing zone and having a maximum first stiffness greater in comparison to zones of the die that are arranged on the end faces that are not in the pressing zone and wherein the maximum first stiffness is at least 10% greater than a minimum second stiffness that is present in at least one zone that is arranged on one of the end faces that is not in the pressing zone; wherein the die has connecting regions spaced from each other at least in a circumferential direction along the radial direction between the inner peripheral surface and the first diameter, wherein the connecting portions are additionally spaced from each other in the axial direction.

16. The die as set forth in claim 15, wherein the first stiffness differs along a circumferential direction.

17. A method for manufacturing at least one green compact with a press, wherein the press has at least one die as set forth in claim 12 and at least one punch that can travel along the axial direction via an end face of the die into a receptacle for the green compact that is formed by the inner peripheral surface, the method comprising at least the following steps:

a) placing a powder in the receptacle;

b) moving the at least one punch in the die along the axial direction and compressing the powder into a green compact in the pressing zone;

c) demolding the green compact from the die via an end face of the die.

18. A method for manufacturing at least one green compact with a press, wherein the press has at least one die as set forth in claim 14 and at least one punch that can travel along the axial direction via an end face of the die into a receptacle for the green compact that is formed by the inner peripheral surface, the method comprising at least the following steps:

a) placing a powder in the receptacle;

b) moving the at least one punch in the die along the axial direction and compressing the powder into a green compact in the pressing zone;

c) demolding the green compact from the die via an end face of the die.

19. A method for manufacturing at least one green compact with a press, wherein the press has at least one die as set forth in claim 15 and at least one punch that can travel along the axial direction via an end face of the die into a receptacle for the green compact that is formed by the inner peripheral surface, the method comprising at least the following steps:

a) placing a powder in the receptacle;

b) moving the at least one punch in the die along the axial direction and compressing the powder into a green compact in the pressing zone;

c) demolding the green compact from the die via an end face of the die.

* * * * *